US006780006B1

(12) United States Patent
Wong

(10) Patent No.: US 6,780,006 B1
(45) Date of Patent: Aug. 24, 2004

(54) LIGHTER

(76) Inventor: Chi Lam Wong, 1617 S. Euclid Ave., San Gabriel, CA (US) 91776

( * ) Notice: Subject to any disclaimer, the term of this patent is extended or adjusted under 35 U.S.C. 154(b) by 0 days.

(21) Appl. No.: 10/633,220

(22) Filed: Aug. 2, 2003

(51) Int. Cl.[7] ..... F23Q 1/02
(52) U.S. Cl. ..... 431/277; 431/255
(58) Field of Search ..... 431/277, 255, 431/251, 146

(56) References Cited

U.S. PATENT DOCUMENTS 4,595,352 A * 6/1986 Endelson ..... 431/254
5,222,889 A * 6/1993 Hsu ..... 431/255
6,267,582 B1 * 7/2001 Lin ..... 431/153
6,402,506 B1 * 6/2002 Lin ..... 431/153

* cited by examiner

*Primary Examiner*—Alfred Basichas

(57) ABSTRACT

This invention relates to a kind of lighter comprising: a housing, a storage, a outlet control bar, at least an ignition chamber, at least an igniter and a head cover, characterized in that it also includes a middle seat for supporting said ignition chamber, and said inlet valve is provided on the side of outlet valve of said storage, and on the valve core of said inlet valve there is provided with a rotatable gear adjustment mechanism engaging with a gear provided on the case of said outlet valve. Such a structure may easily adjust the amount of gas as outlet and is simple in structure and may not affect use after injection of gas thereinto.

5 Claims, 4 Drawing Sheets

LIGHTER

FIELD OF THE INVENTION

The present invention relates to an ignition device, and particularly to a lighter with a head cover using inflammable gas stored in liquidity as fuel.

BACKGROUND OF THE INVENTION

Currently, lighters on market include windproof lighters and flammable lighters, and generally the lighter with a head cover has its inlet and outlet valves provided at the bottom of a gas chamber and a small hole provided at the bottom portion of the case corresponding to the core of the inlet valve, and when gas being injected thereto, the gas chamber must be fixed by a screw to the housing to prevent the gas chamber from being falling off. Such structure very often makes it difficult to align the screw hole of the housing to the gas chamber in the process of manufacture, and in addition, when gas is injected into the gas chamber, some part of gas may enter the ignition chamber through possible gaps within the housing, making the gas within said ignition chamber disproportionably mixed and the lighter just injected with gas unable to be ignited and can not be used unless a portion of the gas left dispersed. In addition, a lighter with a head cover usually has an adjustment mechanism of its outlet valve provided at the bottom of the gas chamber and a sealing ring on a adjustment rod for sealing with the hole corresponding to the bottom of the gas chamber, and when it is in need of relatively big or small flames, the adjustment rod shall be rotated to adjust the gas amount within the ignition chamber to meet the requirement. According to such a structure, though it is easy to make an adjustment, a gas leakage happens very often, and if it is assembled very tightly, the gas leakage would be prevented to some extent, but it would be uneasily operated as the adjustment has been made clumsy.

SUMMARY OF THE INVENTION

One objective of the present invention is to provide a lighter which may have its amount of the outlet gas easily adjusted.

Another objective of the present invention is to provide a lighter which needs no fixation between the gas chamber and the lighter housing and may be assembled as a single one body and easily injected with gas.

Further another objective of the present invention is to provide a lighter having its mixed gas within the ignition chamber unaffected from the gas injection assuring the time and results of the ignition.

The lighter according to the present invention has an inlet valve provided adjacent to an outlet valve, an middle seat provided between said outlet valve and said ignition chamber for supporting said ignition chamber, a rotatable gear adjustment mechanism provided on the core of said inlet valve, and a gear provided on the outer case of said outlet valve and engaged with said gear adjustment mechanism. The lighter may be easily assembled by merely putting the lighter core set into said housing, and when it is in need of gas, the inlet valve on said middle seat may be directly used for pressing the gas thereinto and the lighter may be used thereafter at once. Further, the means for controlling the amount of gas within the combustion chamber, said gear adjustment mechanism is provided on the valve core of said inlet valve, which may turn the gear on the case of outlet valve, so as to adjust the amount of gas from the outlet valve, achieving the goal of seal and easy adjustment.

In addition, since there is no need for a fixed structure for assembly of whole set between said gas chamber and lighter housing, a sealing means may consequently be added at the conjunction between said lighter housing and the housing head cover, and the lighter with such structure has a very good water proof effect and may meet the requirement for work under water.

Additionally, as said gear adjustment mechanism according to the present invention is provided upward along with the axis of said inlet valve, at least partially protruding out of said middle seat, or is located within or outside of the seat, the results of adjusting the amount of gas may be easily achieved.

The objectives of the present invention are achieved in such a way that: it includes a lighter housing, a storage within said housing having an outlet valve, an inlet valve and a gas chamber for storing flammable liquid gas, an outlet gas control bar for controlling gas supply from said storage, at least an ignition chamber connected to a gas passage of said storage, at least an ignition means, a head cover for covering said ignition chamber, characterized in that it also includes an middle seat provided between said outlet valve and said ignition chamber to support said ignition chamber. Said storage has its inlet valve provided besides said outlet valve and the port of said inlet valve arranged upward. On the core of said inlet valve there is also provided with a gear adjustment mechanism, and on the case of said outlet valve there is provided with a gear engaged with said gear adjustment mechanism.

Wherein said gear adjustment mechanism includes a transmission gear and a rotation head.

Further, said rotation head is of gear type or slot structure.

Furthermore, said gear adjustment mechanism is provided upward along with the axis of said inlet valve, at least partially protruding over said middle seat, or is located within the seat, or partially exposed at side of the seat.

BRIEF DESCRIPTION OF THE DRAWINGS

Next, further description will be made to the present invention by reference to the following drawings wherein.

Figure 1:
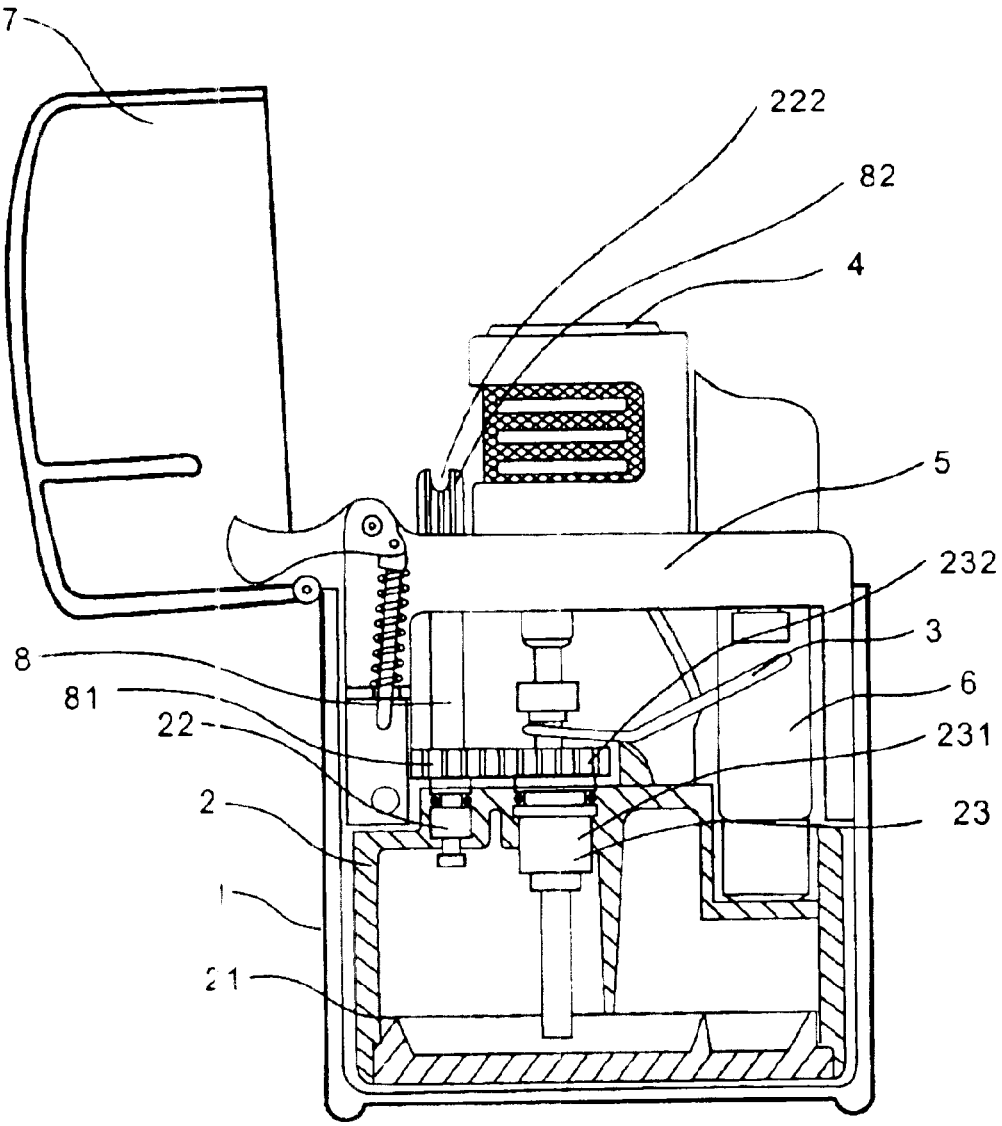
FIG. 1 is a structural illustration showing the structure of the first embodiment of the present invention.

Wherein:

1—lighter housing; 2—storage; 21—gas chamber; 22—inlet valve; 221—valve core; 222—port of inlet valve; 23—outlet valve; 231—case of outlet valve; 232—gear of case of outlet valve; 233—multiple-pore sponge; 234—absorbent means; 3—outlet control bar; 4,4'—ignition chamber; 5—middle seat; 6,6'—igniter; 7—head cover; 8—gear adjustment mechanism; 81—transmission gear; 82—rotation head.

DETAILED DESCRIPTION OF THE INVENTION

Refer to all the drawings: the multiple-flame lighter according to the present invention, including a housing 1, a gas chamber 21 for holding flammable liquid gas and a storage 2 including outlet valve 23 and inlet valve 22, outlet control bar 3 for controlling gas supply to said storage 2, ignition chamber 4 connecting to the gas passage of said storage 2, electronic igniter 6, head cover for protecting ignition chamber 4. There is also a middle seat 5 provided between said outlet valve 23 and said ignition chamber 4 for supporting said ignition chamber 4, wherein said inlet valve 22 having its outlet port arranged upward is provided besides said outlet 23.

Figure 2:
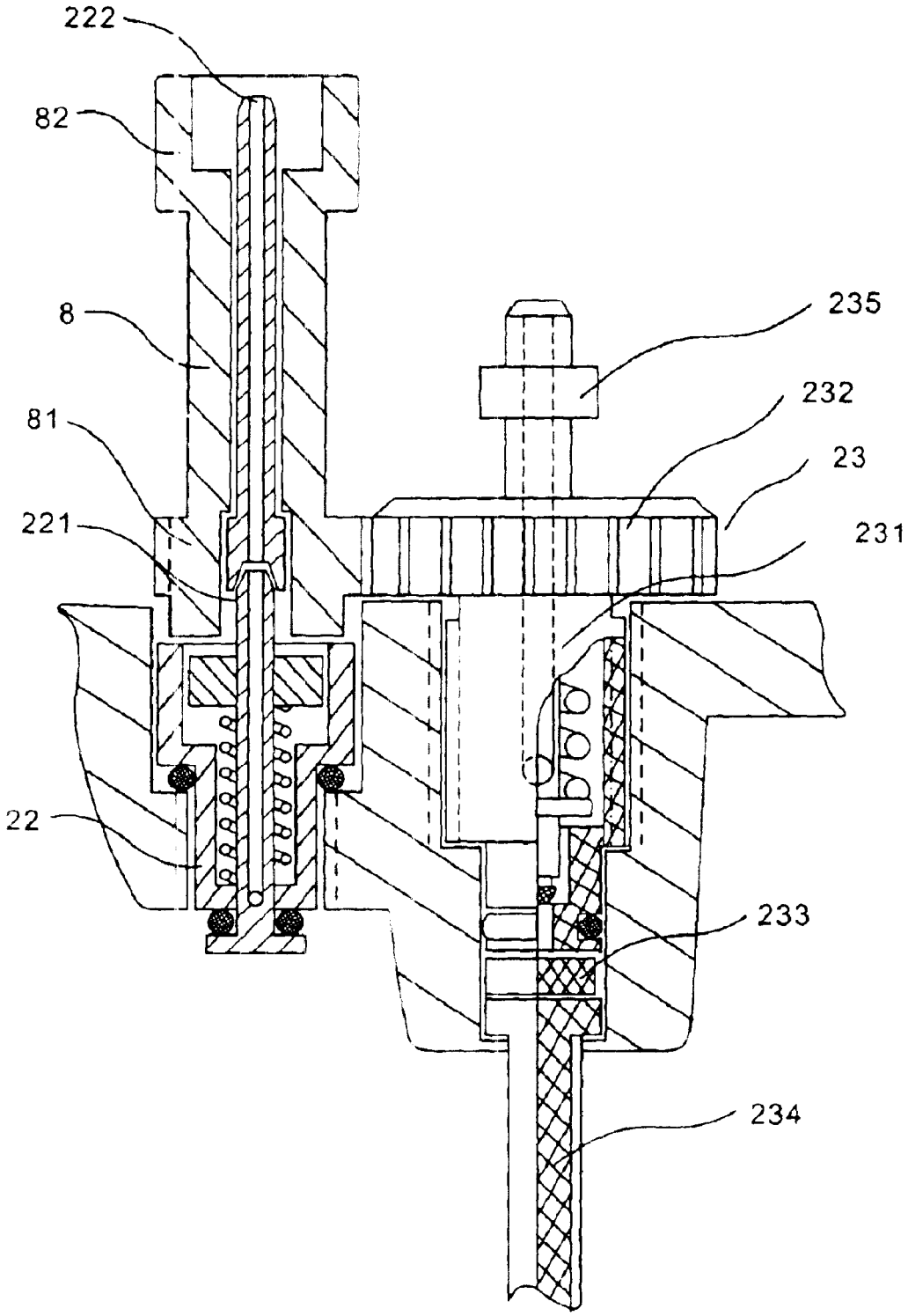
FIG. 2 is a sectional view showing the partial structure of the outlet and inlet valves.

Refer to FIG. 2. On the valve core 221 of said inlet valve 22 there is provided with a rotatable gear adjustment mechanism 8 including a transmission gear 81 and rotation head 82. According to the embodiment as shown in FIG. 1, said rotation head 82 has a slot structure, which may be easily rotated by human finger reached to said slots. And on said outlet valve 23 there is provided with gear 232 being engaged with said gear adjustment mechanism 8. When said storage 2 is to be injected with gas, it may be simply done by aligning the outlet port of gas supply to the inlet port 222 of said inlet valve 22 on said middle seat 5. Since the force for the injection is applied towards the inside of said lighter housing, there is no need to fix the lighter case, and further, the screw fixation of said storage 2 to housing 1 may be omitted. With such a structure, the gas injection into the lighter may be conveniently operated.

As said gear adjustment mechanism 8 protrudes at least partially over said middle seat 5 or is located within said middle seat 5, some gas leaked, if any, during the injection operation may not easily enter said ignition chamber 4 and housing 1, and the lighter may be used immediately after the injection operation and good ignition result may not be affected.

Refer to FIG. 1, as there is a certain space between said inlet valve 22 and said middle seat 5, valve core 221 may be made of a separate structure (see FIG. 2) to prevent deformation of valve core 221 caused by possibly excessive length during the process of gas injection and adverse affect to the sealing means of said valve core 221.

Refer to FIG. 2, if there is need for relatively higher flame or the flame is too short when the lighter is being used, said rotation head 82 on one end of said middle seat 5 within said gear adjustment mechanism 8 may be turned by hand, and the gear 81 on other end of said gear adjustment mechanism 8 brings in turn said gear 232 on the case 231 of said outlet valve 23 to rotate upwards, releasing said multi-pore sponge 233 in said outlet valve 23, making more gas in said gas chamber 23 pass through the absorbent means 234 and said outlet valve 23, and achieving the result of more gas supply at said outlet valve 23. Apparently the flame at this time is made higher. If there is need for shorter flame or the flame is exceedingly high when the lighter is being used, said rotation head 82 of said gear adjustment mechanism 8 shall be rotated in the opposite direction, and the gear 81 on other end of said gear adjustment mechanism 8 brings in turn said gear 232 on the case 231 of said outlet valve 23 to rotate downwards, pressing said multi-pore sponge 233 in said outlet valve 23, making less gas in said gas chamber 23 pass through the absorbent means 234 and said outlet valve 23, and achieving the result of less gas supply at said outlet valve 23. Apparently the flame at this time is made shorter. Such operation may make the force of finger sufficiently applied onto the protruding end of said gear adjustment mechanism 8, and even if there is tighter sealing between said case 231 in said outlet valve 23 and said outlet valve core 235 or between said case 231 in said outlet valve 23 and gas chamber 21, easy adjustment and stable sealing may still be achieved.

Figure 3:
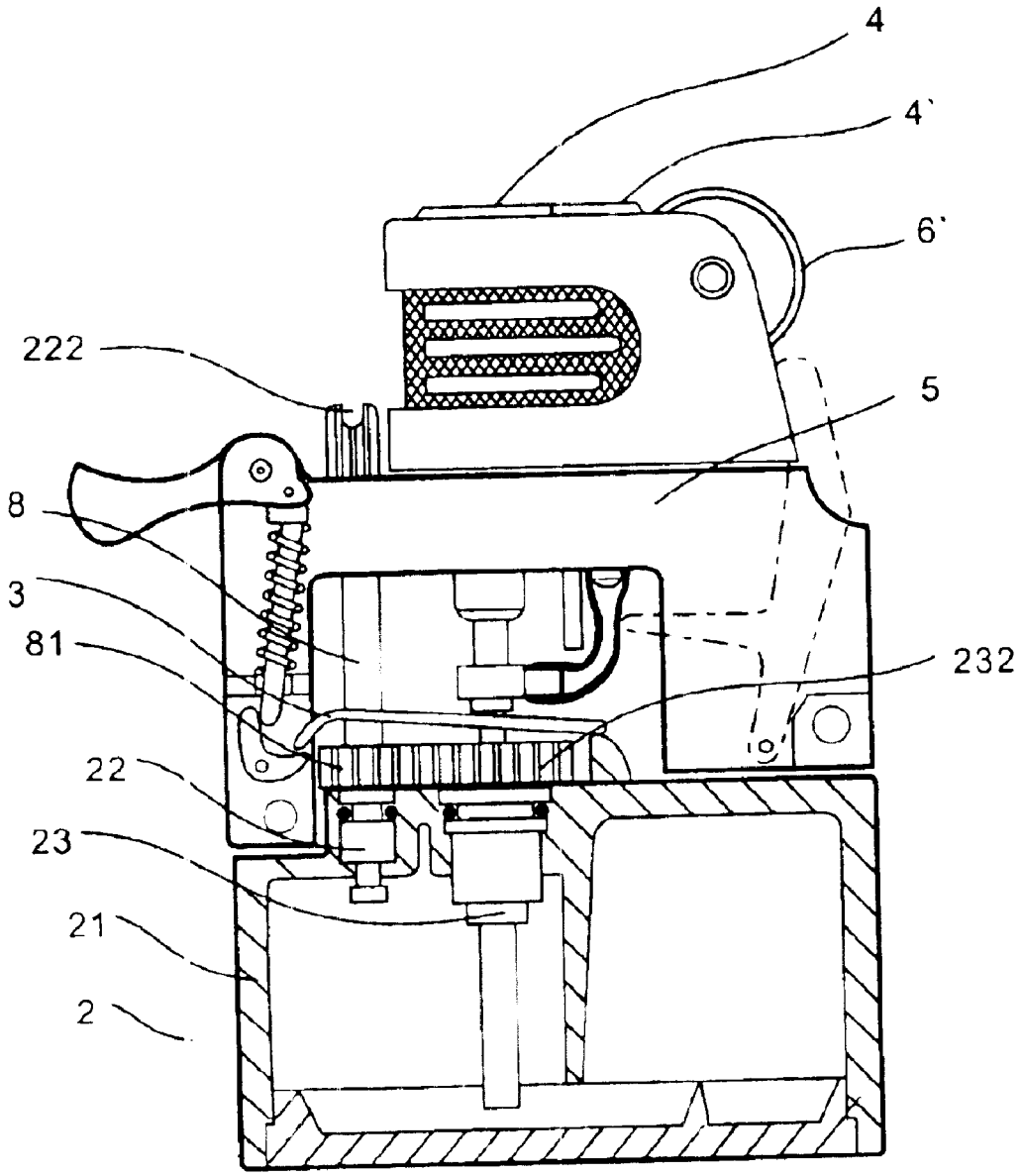
FIG. 3 is a sectional view showing the structure of the second embodiment of the present invention.

Refer to FIG. 3, the technical solution of this embodiment is similar to that as shown by FIG. 1, and mainly differs therefrom in that said igniter 6 also includes a flint sparking means and two ignition chambers: one is a wind-proof ignition chamber 4 and the other is flame ignition chamber 4'.

Figure 4:
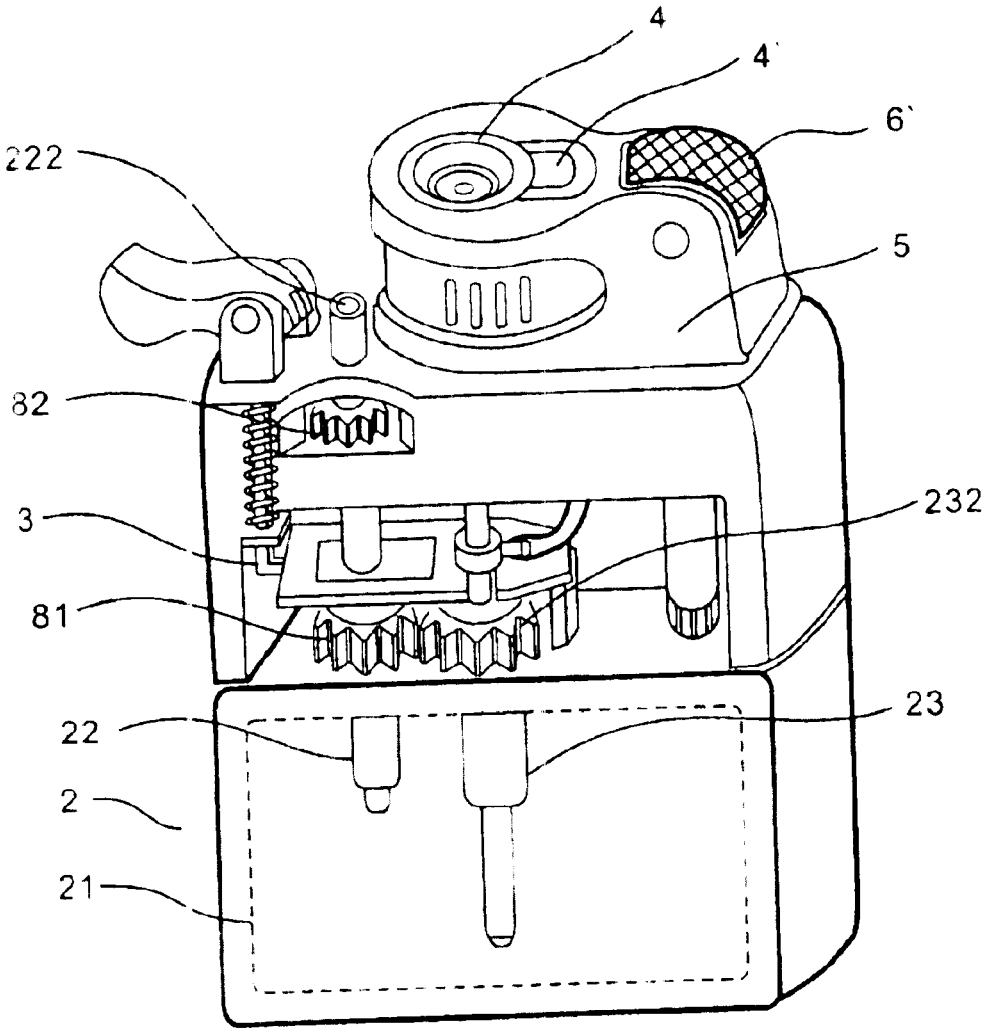
FIG. 4 is a sectional view showing the structure of the third embodiment of the present invention.

Refer to FIG. 4, the technical solution of this embodiment is similar to that as shown in FIG. 3 in that it also has two ignition chambers: one is wind-proof ignition chamber 4 and the other is a flame ignition chamber 4'. The main difference therebetween is that the rotation head 82 of said gear adjustment mechanism 8 is of gear-type structure, and in addition, a part of said rotation head 82 of said gear adjustment mechanism 8 is exposed on one side of middle seat 5 for easy adjustment of gas supply from said outlet valve 23.

Though the preferable embodiments have been described in details by reference to the drawings, it is apparent however to those skilled in the art that the above description is only to illustrate the invention and is not limitation thereto, and various variations or modification may be made to the embodiments within the spirit of the present inventive concept, and fall within the scope of the protection of the present invention.

What is claimed is:

1. A lighter, comprising:

a lighter housing, a storage within said housing having an outlet valve, an inlet valve and a gas chamber for storing flammable liquid gas, an outlet gas control bar for controlling gas supply from said storage, at least an ignition chamber connected to a gas passage of said storage, at least an ignition means, a head cover for protecting said ignition chamber, wherein the lighter further includes a middle seat provided between said outlet valve and said ignition chamber to support said ignition chamber, and said storage has its inlet valve provided besides said outlet valve and the port of said inlet valve arranged upward, and on the core of said inlet valve there is also provided with a gear adjustment mechanism, and on the case of said outlet valve there is provided with a gear engaged with said gear adjustment mechanism.

2. A lighter as claimed in claim 1, wherein said gear adjustment mechanism includes a transmission gear and rotation head.

3. A lighter as claimed in claim 2, wherein said rotation head is of gear type or slot structure.

4. A lighter as claimed in claim 1 or 2, wherein said gear adjustment mechanism is arranged upwards along with the axis direction of said inlet valve, and at least partially protrudes over said middle seat or is located within said middle seat.

5. A lighter as claimed in claim 1 or 2, wherein said gear adjustment mechanism is at least partially exposed on one side of said middle seat.

* * * * *